US010486057B2

(12) United States Patent
Henrie et al.

(10) Patent No.: US 10,486,057 B2
(45) Date of Patent: Nov. 26, 2019

(54) COMPETITIVE ESCAPE ROOMS

(71) Applicants: Dallin Henrie, Provo, UT (US); Robert Strain, Provo, UT (US)

(72) Inventors: Dallin Henrie, Provo, UT (US); Robert Strain, Provo, UT (US)

( * ) Notice: Subject to any disclaimer, the term of this patent is extended or adjusted under 35 U.S.C. 154(b) by 128 days.

(21) Appl. No.: 15/710,818

(22) Filed: Sep. 20, 2017

(65) Prior Publication Data

US 2018/0078848 A1 Mar. 22, 2018

Related U.S. Application Data

(60) Provisional application No. 62/396,947, filed on Sep. 20, 2016.

(51) Int. Cl.

| | |
|---|---|
| ***A63F 9/00*** | (2006.01) |
| ***A63J 5/02*** | (2006.01) |
| ***A63F 9/24*** | (2006.01) |
| *A63F 11/00* | (2006.01) |
| *A63J 3/00* | (2006.01) |

(52) U.S. Cl.

CPC ..... *A63F 9/0078* (2013.01); *A63F 9/24* (2013.01); *A63J 5/02* (2013.01); *A63F 2009/2442* (2013.01); *A63F 2011/0095* (2013.01); *A63F 2250/00* (2013.01); *A63J 3/00* (2013.01)

(58) Field of Classification Search

CPC ..... A63F 9/0078; A63F 2011/0095; A63F 2250/24; A63G 33/00; A63J 3/00; A63J 5/02

USPC ..... 463/9, 15

See application file for complete search history.

(56) References Cited

U.S. PATENT DOCUMENTS

| | | | | |
|---|---|---|---|---|
| 4,486,017 | A | 12/1984 | Evert, Jr. | |
| 4,569,527 | A | 2/1986 | Rosenwinkel et al. | |
| 5,320,362 | A * | 6/1994 | Bear | A63F 9/0291 273/445 |
| 6,675,538 | B2 * | 1/2004 | Candio | A63J 11/00 273/110 |
| 6,855,062 | B1 * | 2/2005 | Truong | A63J 11/00 472/134 |
| 7,441,777 | B2 | 10/2008 | Thompson | |

(Continued)

FOREIGN PATENT DOCUMENTS

| | | |
|---|---|---|
| CN | 204134185 U | 2/2015 |
| CN | 205055401 U | 3/2016 |

OTHER PUBLICATIONS

"Face-Off Competition Escape Room at America's Escape Game Orlando", https://www.youtube.com/watch?v=fc0a8fwHsYk, published Feb. 9, 2016.*

(Continued)

*Primary Examiner* — Michael A Cuff

(74) *Attorney, Agent, or Firm* — Kunzler Bean & Adamson, PC

(57) ABSTRACT

Apparatuses, systems, methods, and computer program products are presented for competitive escape rooms. A first room has a predetermined method to accomplish a task within the first room. A second room has a same predetermined method to accomplish a same task within the second room as in a first room. A hardware controller device determines in which of a first room and a second room a task is completed first by one of a plurality of competing sets of users.

18 Claims, 5 Drawing Sheets

(56) References Cited

U.S. PATENT DOCUMENTS

| | | | | |
|---|---|---|---|---|
| 8,262,445 | B1 * | 9/2012 | Spigner | A63F 9/0073 273/153 R |
| 8,579,685 | B2 * | 11/2013 | Ciarrocchi | A63F 13/08 463/1 |
| 2007/0191096 | A1 * | 8/2007 | Tanaka | A63F 13/00 463/31 |
| 2013/0141428 | A1 * | 6/2013 | Gipson | G06T 19/003 345/419 |

OTHER PUBLICATIONS

Mitgutsch, Konstantin, "Playing Live-Action Action Escape Rooms in a Competitive Mode?", MIT Game Lab, http://gamelab.mit.edu/playingliveactionescaperoomsinacompetitivemode/, Massachusetts Institute of Technology, Mar. 17, 2015, USA.

"Face Off", America's Escape Game, http://americasescapegame.com/faceoff/, 2016, Sundial Studios, USA.

* cited by examiner

COMPETITIVE ESCAPE ROOMS

CROSS-REFERENCES TO RELATED APPLICATIONS

This application claims the benefit of U.S. Provisional Patent Application No. 62/396,947 entitled "COMPETITIVE ESCAPE ROOMS" and filed on Sep. 20, 2016 for Dallin Henrie, et al., which is incorporated herein by reference.

FIELD

This invention relates to escape room games and more particularly relates to apparatuses and systems for competitive escape rooms.

BACKGROUND

Solving clues and puzzles to reach a prize or to escape a room can be entertaining and educational, and can encourage cooperation and team building. Unlike most other games, escape rooms do not have a competitive aspect. A player or team's performance in one room cannot be fairly compared to a player or team's performance in a different room, as different rooms have different clues and puzzles, and therefore different degrees of difficulty.

SUMMARY

Systems for competitive escape rooms are presented. In one embodiment, a first room has a predetermined method to accomplish a task within the first room. A second room, in certain embodiments, has a same predetermined method to accomplish a same task within the second room as in a first room. In some embodiments, a hardware controller device determines in which of a first room and a second room a task is completed first by one of a plurality of competing sets of users.

Methods for competitive escape rooms are presented. A method, in one embodiment, includes providing a first room having a predetermined method to accomplish a task within the first room. In certain embodiments, a method includes providing a second room having a same predetermined method to accomplish a same task within the second room as within a first room. A method, in some embodiments, includes providing a shared chamber accessible from both a first room and a second room and at least a portion of a task comprises gaining access to the shared chamber. In a further embodiment, a method includes determining, using a hardware controller device, from which of a first room and a second room access into a shared chamber is gained first.

Apparatuses for competitive escape rooms are presented. In one embodiment, an apparatus includes means for monitoring a completion status of a predetermined method to accomplish a task within a first room. An apparatus, in some embodiments, includes means for monitoring a completion status of a same predetermined method to accomplish a same task within a second room as in a first room. In certain embodiments, an apparatus includes means for determining in which of a first room and a second room a task is completed first by one of a plurality of competing sets of users.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
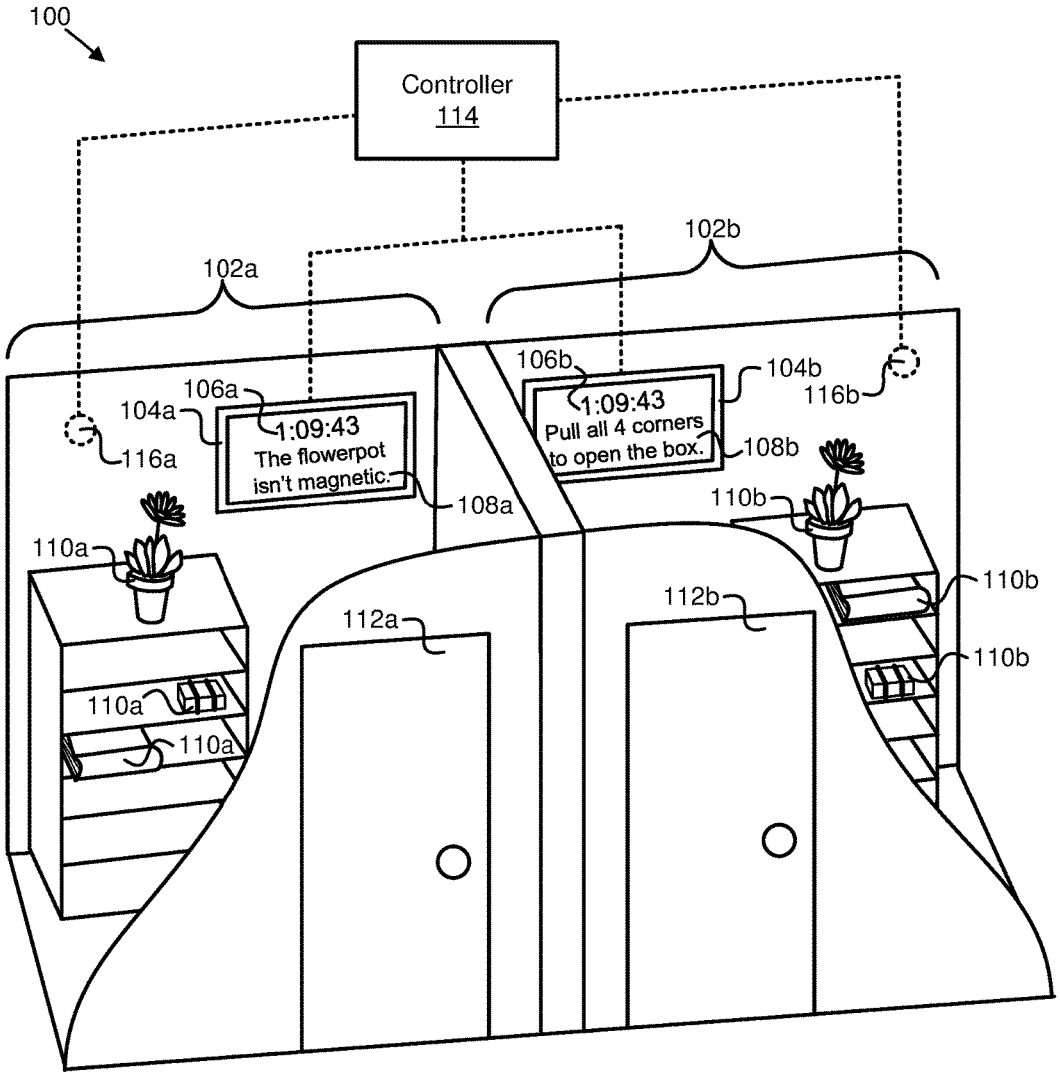
FIG. 1 is a perspective view illustrating one embodiment of competitive escape rooms.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages of the embodiments will become more fully apparent from the following description and appended claims, or may be learned by the practice of embodiments as set forth hereinafter. As will be appreciated by one skilled in the art, aspects of the present invention may be embodied as a system, method, and/or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the present invention may take the form of a computer program product embodied in one or more computer readable medium(s) having program code embodied thereon.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of program code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of program code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the program code may be stored and/or propagated on in one or more computer readable medium(s).

The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory ("RAM"), a read-only memory ("ROM"), an erasable programmable read-only memory ("EPROM" or Flash memory), a static random access memory ("SRAM"), a portable compact disc read-only memory ("CD-ROM"), a digital versatile disk ("DVD"), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and computer program products according to various embodiments of the present invention. In this regard, each block in the schematic flowchart diagrams and/or schematic block diagrams may represent a module, segment, or portion of code, which comprises one or more executable instructions of the program code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and program code.

FIG. 1 depicts one embodiment of competitive escape rooms 102*a*, 102*b*. In the depicted embodiment, each escape room 102*a*, 102*b* comprises an electronic display 104*a*, 104*b*, a set of objects 110*a*, 110*b*, a door 112*a*, 112*b*, and one or more sensors 116*a*, 116*b*. In certain embodiments, one or more hardware controller devices 114 are in communication with the electronic displays 104*a*, 104*b* and/or the one or more sensors 116*a*, 116*b*.

In one embodiment, the first room 102*a* and the second room 102*b* are substantially identical. Substantially identical rooms 102*a*, 102*b* may allow different sets of users to compete in the different rooms 102*a*, 102*b* to accomplish a task within the different rooms 102*a*, 102*b*, to determine which set of users (e.g., team) can accomplish the task first, such as escaping a room 102*a*, 102*b*, locating and/or unlocking a treasure or other reward, or the like. Because the steps for accomplishing the same task in the different rooms 102*a*, 102*b* may be objectively similar, the competition between different teams or sets of users may be a fair comparison.

In one embodiment, two or more rooms 102*a*, 102*b* are substantially identical if the rooms 102*a*, 102*b* are configured to allow users to accomplish the same task (e.g., reach a treasure or other reward, unlock a door 112*a*, 112*b*, escape the room 102*a*, 102*b* ) in the different rooms 102*a*, 102*b*. In certain embodiments, different rooms 102*a*, 102*b* are substantially identical if the rooms 102*a*, 102*b* have the same theme and/or story for accomplishing the same task (e.g., a mafia, detective, Egyptian, zombie, wild west, nuclear reactor, outer space, and/or other themed rooms 102*a*, 102*b* and/or stories). In a further embodiment, two or more rooms 102*a*, 102*b* are substantially identical if the rooms 102*a*, 102*b* include similar sets of objects 110*a*, 110*b* to assist users in accomplishing the same task in the different rooms 102*a*, 102*b*.

In various embodiments, different rooms 102*a*, 102*b* may have one or more of the same objects 110*a*, 110*b* of different colors or sizes and still be substantially identical, may have a different shape and/or size and still be substantially identical, may have objects 110*a*, 110*b* in different positions (e.g., in mirrored positions, in random positions, or the like) and still be substantially identical, and/or may have one or more other differences that do not materially affect a set of user's ability to accomplish the task and still be substantially identical. In another embodiment, the different rooms 102*a*, 102*b* may be completely identical, with no differences in the sets of objects 110*a*, 110*b* in the different rooms; no differences in size, shape, or color; being completely identical in every detail.

Each room 102*a*, 102*b* may include a plurality of objects 110*a*, 110*b* (e.g., seemingly everyday objects, objects that coordinate with a theme of the room 102*a*, 102*b*, or the like) which contain clues for accomplishing a task, which are themselves usable for accomplishing a task, or the like. Competing teams or other sets of users in the different rooms 102*a*, 102*b* may use the respective set of objects 110*a*, 110*b* in their room 102*a*, 102*b* to unlock clues and take a predefined series of steps to accomplish a task within their room 102*a*, 102*b*. For example, a book 110*a* may comprise a hidden safe that can only be unlocked by locating a key within another, seemingly decorative object 110*a*, and the hidden safe may store a magnifying glass allowing a user to see images displayed on a computer monitor or other electronic display which are otherwise not visible, due to a filter overlay, or the like, and the images may include a further clue and/or puzzle to assist in accomplishing the overall task. Users in different rooms 102*a*, 102*b* may compete to accomplish identical tasks (e.g., reach a treasure, reward, or other object; escape a room 102*a*, 102*b*; or the like) or complimentary but opposing tasks (e.g., users in one room 102*a*'s task is to create a simulated virus, while users in the other room 102*b*'s task is to cure and/or stop the virus).

The first and second rooms 102*a*, 102*b*, in certain embodiments, are configured to prevent communication and/or limit collaboration between competing sets of users in the different rooms 102*a*, 102*b*, at least prior to the task being completed. For example, the rooms 102*a*, 102*b*, in one embodiment, do not include windows between the rooms 102*a*, 102*b*, or windows between the rooms 102*a*, 102*b* are not available until at or near a time when the task is complete. In a further embodiment, the rooms 102*a*, 102*b* may have a soundproofing treatment to prevent communication and/or limit collaboration. In certain embodiments, due to a shared chamber or the like, as described below, toward an end of accomplishing a task, after a task has been completed, or the like, users may reach or unlock a window or other transparent divider within the shared chamber, to allow competing sets of users to determine whether another set of users have accomplished its task yet.

In one embodiment, each room 102*a*, 102*b* includes one or more electronic displays 104*a*, 104*b*. One or more hardware controller devices 114 (e.g., a single hardware controller device 114 for all the rooms 102*a*, 102*b*, separate coordinating hardware controller devices 114 for each room 102*a*, 102*b*, or the like) displays a same one or more timers 106*a*, 106*b* on displays 104*a*, 104*b* in each of the rooms 102*a*, 102*b*. One or more hardware controller devices 114, in a further embodiment, may display one or more different messages 108*a*, 108*b* on the electronic displays 104*a*, 104*b* in the different rooms 102*a*, 102*b*, with different clues, hints, or the like for accomplishing the same task in the different rooms 102*a*, 102*b* (e.g., based on different progresses of the different sets of users, based on different sets of users unlocking a different trigger, based on different sets of users having different skill levels, or the like).

In one embodiment, the different rooms 102*a*, 102*b* include one or more sensors 116*a*, 116*b*. The one or more sensors 116*a*, 116*b* may determine when a user has triggered an action within a room 102*a*, 102*b* and may unlock and/or trigger an additional clue, hint, action, or the like to allow a set of users to progress toward accomplishing the task. In a further embodiment, the one or more sensors 116*a*, 116*b* may allow one or more administrators to monitor and/or communicate with users within the rooms 102*a*, 102*b* from another location (e.g., from a control room). The one or more sensors 116*a*, 116*b* may include one or more of a camera (e.g., a video camera, a still camera, an infrared and/or night vision camera, a webcam, or the like), a microphone, a scale or weight sensor, a water or moisture sensor, a light or other optical sensor, a motion sensor, a magnetic contact, a biometric sensor (e.g., fingerprint reader, iris scanner, face scanner, or the like), a voice or music sensor triggered by a predefined voice and/or audio pattern, a button, a switch, a dial, or the like.

The hardware controller device 114 may perform an action based on input from the one or more sensors 116*a*, 116*b*, such as unlocking a door, displaying a hint or clue on an electronic display 104*a*, 104*b*, playing a video and/or audio message, or the like. The hardware controller device 114, in a further embodiment, may determine that the task is completed in one of the rooms 102*a*, 102*b* based on input from one or more sensors 116*a*, 116*b*, may stop a corresponding timer 106*a*, 106*b* in the room 102*a*, 102*b* in which the task is completed, may determine a winner, or the like. For example, in one embodiment, users may start a game with the different rooms 102*a*, 102*b* in complete darkness, and may trigger a sensor 116*a*, 116*b* to cause the hardware controller device 114 to activate a light source, may locate a light source (e.g., a hidden light switch, flashlight, glow stick, television or other electronic display 104*a*, 104*b*, a motion sensor 116*a*, 116*b* or other sensor 116*a*, 116*b*, a torch, or the like), or otherwise perform a trigger to light the room 102*a*, 102*b*. In a further embodiment, a user may trigger a sensor 116*a*, 116*b* to reveal or otherwise make accessible a passageway (e.g., behind a shelf, through a wall, behind a picture frame, or the like) through which a user may walk or crawl.

In one embodiment, the one or more hardware controller devices 114 are in communication with the electronic displays 104*a*, 104*b* and/or the one or more sensors 116*a*, 116*b*. A hardware controller device 114 may comprise a computing device (e.g., with a processor, volatile memory, non-volatile storage, and/or the like), a field programmable gate array (FPGA), an application specific integrated circuit (ASIC), and/or another hardware controller configured to determine and/or assist an administrator in determining in which room 102*a* 102*b* a competing set of users first accomplishes a predefined task or goal.

In certain embodiments, a room 102*a*, 102*b* may comprise one or more virtual reality headsets and/or displays for competing sets of users, to assist the competing sets of users in accomplishing the task. For example, a virtual reality headset may be unlockable and/or discoverable within a room 102*a*, 102*b*, users may be provided virtual reality headsets prior to entering a room 102*a*, 102*b*, or the like. The one or more virtual reality headsets may be configured to provide one or more interactive, virtual reality clues to one or more users, for accomplishing the task. For example, a virtual reality headset may display an interactive virtual character that provides a clue (e.g., a virtual time traveler with a clue to diffuse a simulated bomb, or the like), may display a virtual tool (e.g., visible only through the virtual reality headset) for solving a real world clue within a room 102*a*, 102*b* (e.g., using an augmented reality overlay or the like), and/or may provide other virtual reality and/or augmented reality assistance in accomplishing a task.

In one embodiment, in response to a trigger, the one or more virtual reality headsets may be configured to unlock a simulated x-ray vision effect allowing at least one user of the competing sets of users to view a video feed (e.g., from a sensor 116*a* ) of a competing set of users in a different room 102*a*, 102*b*. For example, the one or more virtual reality headsets may display the video feed as an augmented reality overlay on a shared wall between rooms 102*a*, 102*b*, may display the video feed as an augmented reality overlay on a wall of a first room 102*a* that is not shared with a second room 102*b* to provide an illusion of a shared wall, or the like.

In one embodiment, the different rooms 102*a*, 102*b* include one or more electronic indicators (e.g., lights embedded in a wall or ceiling, icons or other graphics on an electronic display 104*a*, 104*b*, or the like) displaying a completion status of the task by users in another room 102*a*, 102*b*, allowing competing sets of users to determine how close other sets of users are to accomplishing the task. For example, the one or more hardware controller devices 114 may display a score or other progress indicator on an electronic display 104*a*, 104*b*, may illuminate a series of lights in a row successively, may illuminate lights of different colors (e.g., green, then yellow, then red as a competing team progresses), or the like to indicate progress of a different set of users.

Figure 2A:
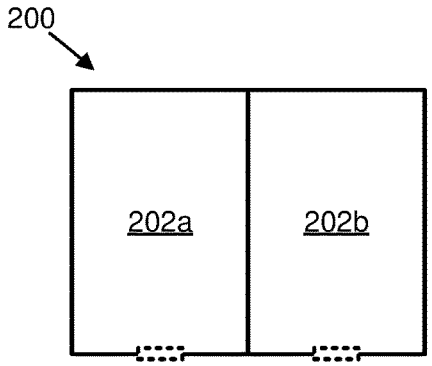
FIG. 2A is a schematic block diagram illustrating a further embodiment of competitive escape rooms.
Figure 2B:
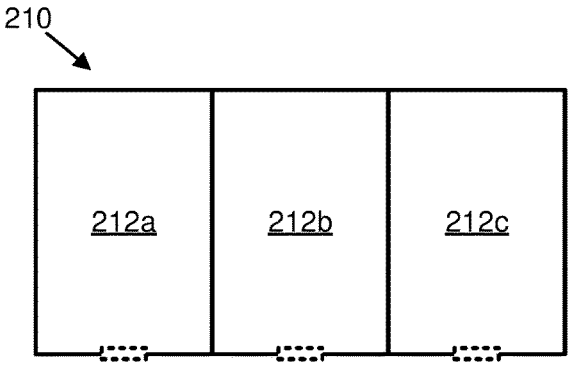
FIG. 2B is a schematic block diagram illustrating another embodiment of competitive escape rooms.
Figure 2C:
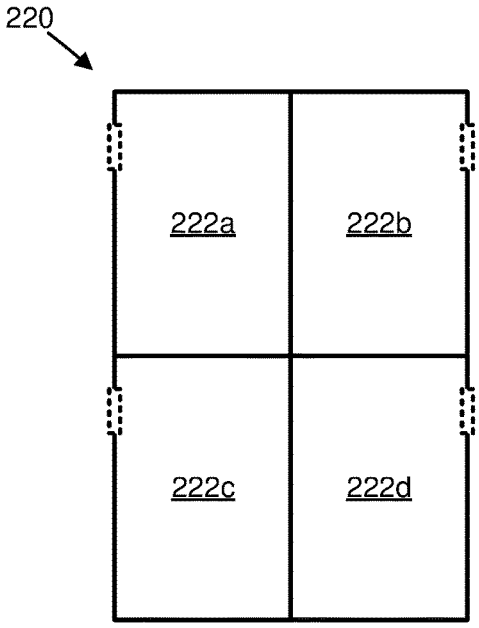
FIG. 2C is a schematic block diagram illustrating an additional embodiment of competitive escape rooms.

FIG. 2A depicts one embodiment 200 with two substantially identical escape rooms 202*a*, 202*b*. FIG. 2B depicts another embodiment 210 with three substantially identical escape rooms 212*a*, 212*b*, 212*c*. FIG. 2C depicts a further embodiment 220 with four substantially identical escape rooms 222*a*, 222*b*, 222*c*, 222*d*.

Figure 3A:
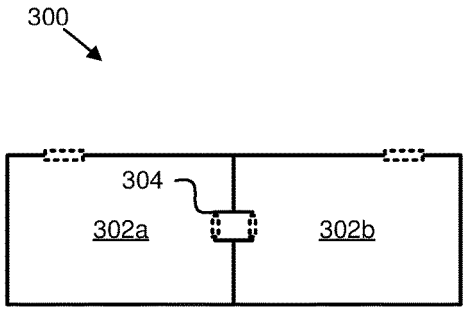
FIG. 3A is a schematic block diagram illustrating one embodiment of competitive escape rooms.
Figure 3B:
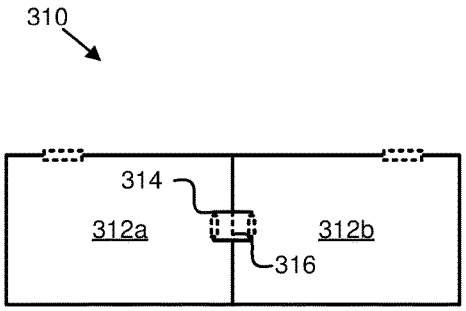
FIG. 3B is a schematic block diagram illustrating another embodiment of competitive escape rooms.
Figure 3C:
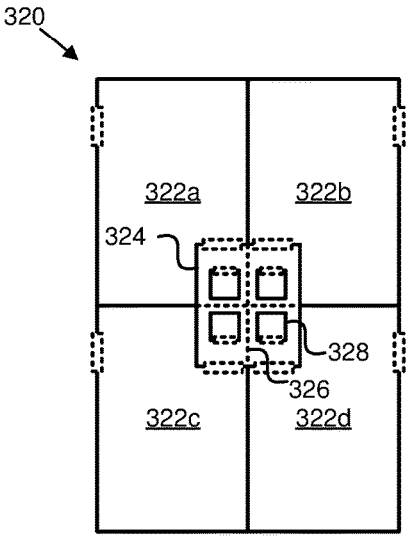
FIG. 3C is a schematic block diagram illustrating a further embodiment of competitive escape rooms.

FIG. 3A, FIG. 3B, and FIG. 3C depict various embodiments 300, 310, 320 with shared chambers 304, 314, 324. A shared chamber 304, 314, 324, in the depicted embodiments 300, 310, 320, is accessible from multiple rooms (e.g., rooms 302*a* and 302*b* of FIG. 3A, rooms 312*a* and 312*b* of FIG. 3B, rooms 322*a*, 322*b*, 322*c*, 322*d* of FIG. 3C, or the like). At least a portion of a task may comprise gaining access to a shared chamber 304, 314, 324 (e.g., a treasure or other reward may be disposed within a shared chamber 304, 314, 324; a key, a safe or lock combination, or the like may be disposed within a shared chamber 304, 314, 324, or the like).

In certain embodiments, a shared chamber 304, 314, 324 may comprise a room, with doors connecting it to multiple rooms 302*a*, 302*b*; 312*a*, 312*b*; 322*a*, 322*b*, 322*c*, 322*d*. In a further embodiment, a shared chamber 304, 314, 324 may comprise a shared safe, with multiple safe doors making the shared chamber 304, 314, 324 accessible to multiple rooms 302*a*, 302*b*; 312*a*, 312*b*; 322*a*, 322*b*, 322*c*, 322*d*.

In one embodiment, a shared chamber 304, 314, 324 comprising a transparent wall or other divider 316, 326 disposed within the shared chamber 304, 314, 324 between different rooms 312*a*, 312*b*; 322*a*, 322*b*, 322*c*, 322*d*. A transparent divider 316, 326 may allow competing sets of users in different rooms 312*a*, 312*b*; 322*a*, 322*b*, 322*c*, 322*d* to view whether another competing set of users in a different room has completed the task once they have completed their task, or at least entered a shared chamber 304, 314, 324, while preventing different sets of users from interfering with another set of users' task. For example, in embodiments without a divider 316, 326, different competing sets of users may compete for the same treasure, reward, or other object (e.g., a single "holy grail" or other single goal) which only one team may obtain or accomplish, thereby preventing other sets of users from accomplishing the single goal and completing the task. In embodiments with a divider 316, 326, the shared chamber 304, 314, 324 may include separate treasures, rewards, or other objects so that each competing set of users may obtain it and accomplish the task, not just the first or winning set of users.

Figure 4:
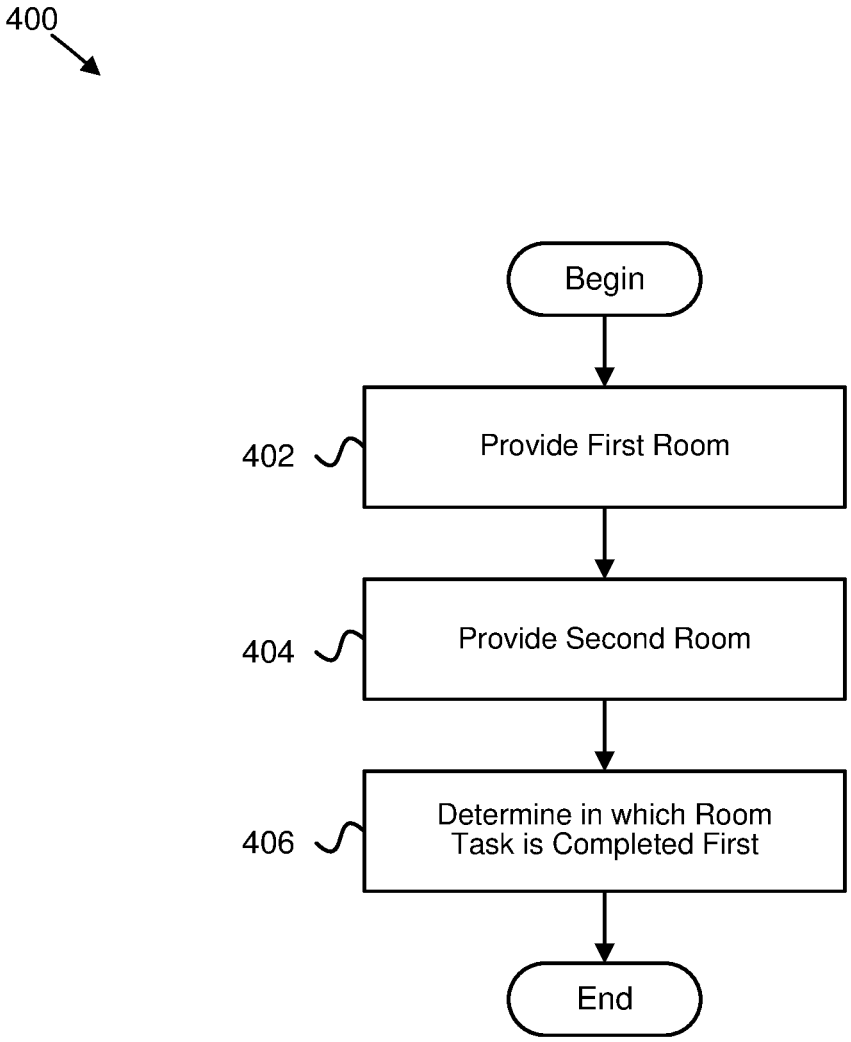
FIG. 4 is a schematic flow chart diagram illustrating one embodiment of a method for competitive escape rooms.

FIG. 4 depicts one embodiment of a method 400 for competitive escape rooms. The method 400 begins, and the hardware controller device 114, an administrator or other user, or the like provides 402 a first room having a predefined method to accomplish a task within the first room.

The hardware controller device 114, an administrator or other user, or the like provides 404 a second room having the same predetermined method to accomplish the same task within the second room as within the first room. The hardware controller device 114, an administrator or other user, or the like determines 406 in which of the first and second rooms the task is completed first by one of a plurality of competing sets of users (e.g., a team of users in each room, or the like) and the method 400 ends.

Figure 5:
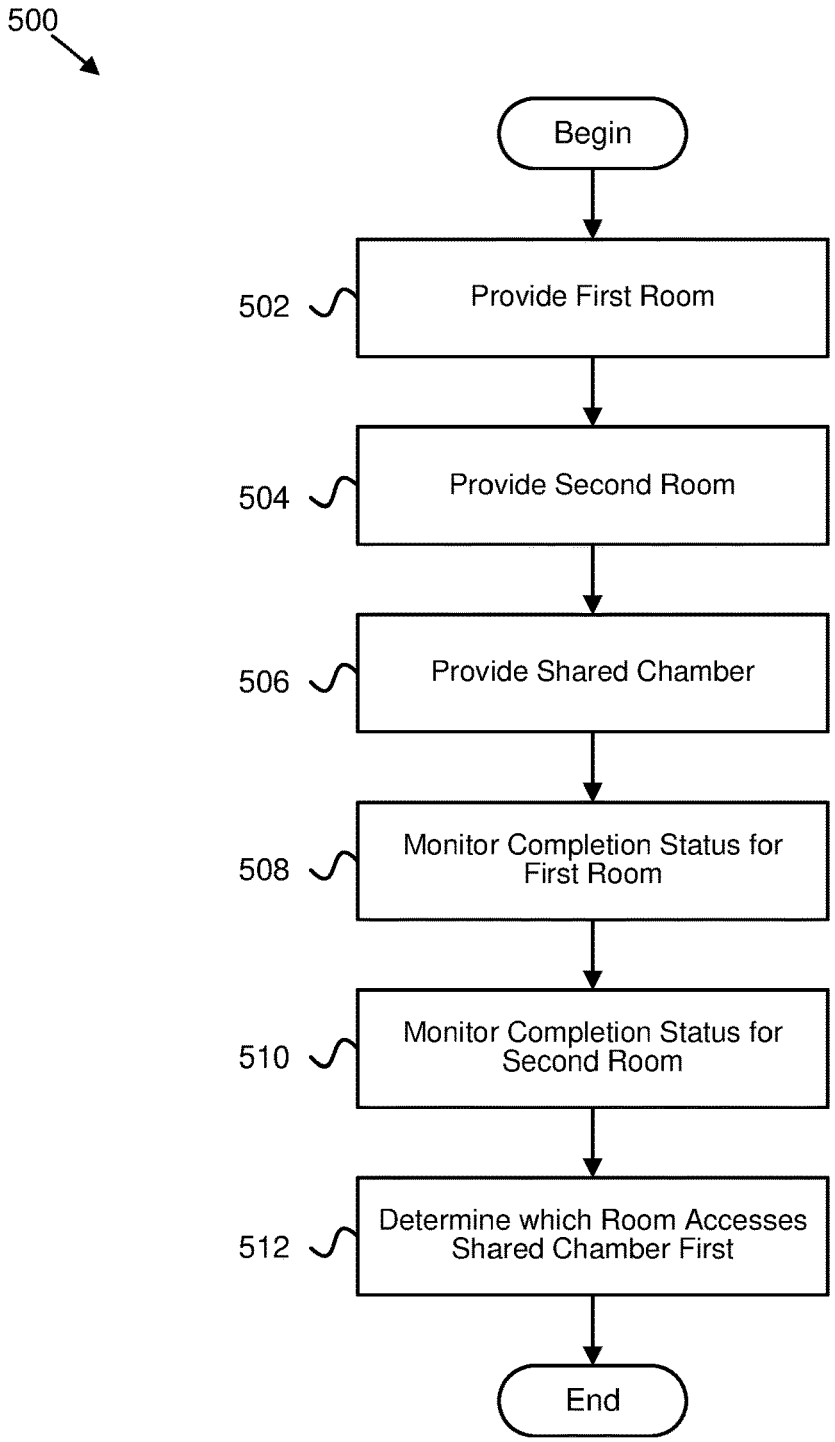
FIG. 5 is a schematic flow chart diagram illustrating a further embodiment of a method for competitive escape rooms.

FIG. 5 depicts a further embodiment of a method 500 for competitive escape rooms. The method 500 begins, and the hardware controller device 114, an administrator or other user, or the like provides 502 a first room having a predefined method to accomplish a task within the first room. The hardware controller device 114, an administrator or other user, or the like provides 504 a second room having the same predetermined method to accomplish the same task within the second room as within the first room.

The hardware controller device 114, an administrator or other user, or the like provides 506 a shared chamber accessible from both the first room and the second room, and at least a portion of the task comprises gaining access to the shared chamber. The hardware controller device 114, an administrator or other user, or the like monitors 508 a completion status of the same predetermined method to accomplish the same task within the first room. The hardware controller device 114, an administrator or other user, or the like monitors 510 a completion status of the same predetermined method to accomplish the same task within the second room. Based on the monitoring 508, 510, the hardware controller device 114, an administrator or other user, or the like determines 512 from which of the first and second rooms access into the shared chamber is gained first.

A means for monitoring a completion status of a predetermined method to accomplish a task within a room, in various embodiments, may include one or more of a hardware controller device 114, a sensor 116, a camera (e.g., a video camera, a still camera, an infrared and/or night vision camera, a webcam, or the like), a microphone, a scale or weight sensor, a water or moisture sensor, a light or other optical sensor, a motion sensor, a magnetic contact, a biometric sensor (e.g., fingerprint reader, iris scanner, face scanner, or the like), a voice or music sensor triggered by a predefined voice and/or audio pattern, a button, a switch, a dial, a processor, computer executable code stored on a non-transitory computer readable storage medium, or the like. Other embodiments may include similar or equivalent means for monitoring a completion status of a predetermined method to accomplish a task within a room.

A means for determining in which room a task is completed first by one of a plurality of competing sets of users, in various embodiments, may include one or more of a hardware controller device 114, a sensor 116, a camera (e.g., a video camera, a still camera, an infrared and/or night vision camera, a webcam, or the like), a microphone, a scale or weight sensor, a water or moisture sensor, a light or other optical sensor, a motion sensor, a magnetic contact, a biometric sensor (e.g., fingerprint reader, iris scanner, face scanner, or the like), a voice or music sensor triggered by a predefined voice and/or audio pattern, a button, a switch, a dial, a processor, computer executable code stored on a non-transitory computer readable storage medium, or the like. Other embodiments may include similar or equivalent means for determining in which room a task is completed first by one of a plurality of competing sets of users.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for competitive escape rooms, the system comprising:

a first room having a predetermined method to accomplish a task within the first room;

a second room having the same predetermined method to accomplish the same task within the second room;

a shared chamber accessible from both the first room and the second room, at least a portion of the task comprising gaining access to the shared chamber;

a single goal within the shared chamber such that a first of the plurality of competing sets of users that accomplishes the single goal completes the task thereby preventing others of the plurality of competing sets of users from accomplishing the goal and completing the task; and a hardware controller device to determine in which of the first and second rooms the task is completed first by one of a plurality of competing sets of users.

2. The system of claim 1, wherein the first and second rooms are configured to limit collaboration between the competing sets of users in accomplishing the task.

3. The system of claim 1, further comprising a transparent divider disposed within the shared chamber between the first room and the second room, allowing one of the competing sets of users in the first room to view whether another of the competing sets of users in the second room has completed the task in the second room, in response to the one of the competing sets of users competing the task in the first room.

4. The system of claim 1, wherein the shared chamber comprises a shared safe, the shared safe comprising at least a first safe door in the first room and a second safe door in the second room.

5. The system of claim 1, further comprising a third room having the same predetermined method to accomplish the same task within the third room, the shared chamber accessible from the third room.

6. The system of claim 5, further comprising a fourth room having the same predetermined method to accomplish the same task within the fourth room, the shared chamber accessible from the fourth room.

7. The system of claim 1, further comprising a first electronic display in the first room and a second electronic display in the second room.

8. The system of claim 7, wherein the hardware controller device displays a same one or more timers on both the first and second electronic displays to both the first and second rooms but displays one or more different messages on the first and second electronic displays to the first and second rooms, the different messages comprising different clues for accomplishing the task.

9. The system of claim 1, further comprising one or more sensors in communication with the hardware controller device, the hardware controller device configured to determine that the task is completed in one of the first and second rooms based on the one or more sensors.

10. The system of claim 1, wherein the first room and the second room are substantially identical.

11. The system of claim 1, further comprising one or more virtual reality headsets for each of the competing sets of users, the one or more virtual reality headsets configured to assist the competing sets of users in accomplishing the task.

12. The system of claim 11, wherein the one or more virtual reality headsets are configured to provide one or more interactive, virtual reality clues for accomplishing the task.

13. The system of claim 11, wherein, in response to a trigger, the one or more virtual reality headsets are configured to unlock a simulated x-ray vision effect allowing at least one user of the competing sets of users to view a video feed of the second room from the first room.

14. The system of claim 13, wherein the one or more virtual reality headsets are configured to display the video feed as an augmented reality overlay on a shared wall between the first and second rooms.

15. The system of claim 13, wherein the one or more virtual reality headsets are configured to display the video feed as an augmented reality overlay on a wall of the first room that is not shared with the second rooms to provide an illusion of a shared wall.

16. The system of claim 1, further comprising one or more electronic indicators disposed in each of the first and second rooms displaying a completion status of the task of one of the plurality of competing sets of users in the other of the first and second rooms.

17. A method for competitive escape rooms, the system comprising:

providing a first room having a predetermined method to accomplish a task within the first room;

providing a second room having the same predetermined method to accomplish the same task within the second room;

providing a shared chamber accessible from both the first room and the second room, at least a portion of the task comprising gaining access to the shared chamber, wherein the shared chamber comprises a shared safe, the shared safe comprising at least a first safe door in the first room and a second safe door in the second room; and determining, using a hardware controller device, from which of the first and second rooms access into the shared chamber is gained first.

18. An apparatus for competitive escape rooms, the apparatus comprising:

means for monitoring a completion status of a predetermined method to accomplish a task within a first room;

means for monitoring a completion status of the same predetermined method to accomplish the same task within a second room;

means for displaying a same one or more timers on both a first electronic display in the first room and a second electronic display in the second room;

means for displaying one or more different messages on the first and second electronic displays to the first and second rooms, the different messages comprising different clues for accomplishing the task; and means for determining in which of the first and second rooms the task is completed first by one of a plurality of competing sets of users.

* * * * *